US009416542B2

(12) United States Patent
Gelbaum

(10) Patent No.: US 9,416,542 B2
(45) Date of Patent: Aug. 16, 2016

(54) PASSIVE SKYLIGHT DOME CONFIGURED TO INCREASE LIGHT TO INCREASE COLLECTION AT LOW SUN ELEVATION ANGLES AND TO REDUCE LIGHT AT HIGH SUN ELEVATION ANGLES

(71) Applicant: Entech Solar, Inc., Grapevine, TX (US)

(72) Inventor: David Gelbaum, Costa Mesa, CA (US)

(73) Assignee: Entech Solar, Inc., Grapevine, TX (US)

( * ) Notice: Subject to any disclaimer, the term of this patent is extended or adjusted under 35 U.S.C. 154(b) by 0 days.

(21) Appl. No.: 14/856,387

(22) Filed: Sep. 16, 2015

(65) Prior Publication Data

US 2016/0076252 A1 Mar. 17, 2016

Related U.S. Application Data

(60) Provisional application No. 62/050,926, filed on Sep. 16, 2014.

(51) Int. Cl.

| | |
|---|---|
| ***E04D 13/03*** | (2006.01) |
| *F21S 11/00* | (2006.01) |
| *E06B 9/24* | (2006.01) |

(52) U.S. Cl.

CPC ..... *E04D 13/033* (2013.01); *E06B 9/24* (2013.01); *F21S 11/007* (2013.01)

(58) Field of Classification Search

CPC ..... E04D 13/03; E04D 13/033; E06B 9/24; F21S 11/007

USPC ..... 52/200; 359/591

See application file for complete search history.

(56) References Cited

U.S. PATENT DOCUMENTS

| | | | | |
|---|---|---|---|---|
| 9,194,128 | B1 * | 11/2015 | Fawley | E04D 13/0325 |
| 2003/0159364 | A1 * | 8/2003 | Piano | A01G 9/14 52/3 |
| 2007/0180789 | A1 * | 8/2007 | Valentz | E04D 13/03 52/200 |
| 2010/0132279 | A1 * | 6/2010 | Valentz | E04D 13/031 52/200 |
| 2011/0289870 | A1 * | 12/2011 | Nemazi | E04C 1/42 52/200 |
| 2013/0314795 | A1 * | 11/2013 | Weaver | G02B 19/0042 359/591 |

FOREIGN PATENT DOCUMENTS

| | | | | |
|---|---|---|---|---|
| WO | WO 9516100 | A1 * | 6/1995 | E04D 13/033 |

* cited by examiner

*Primary Examiner* — Christopher Mahoney

(74) *Attorney, Agent, or Firm* — Duane Morris LLP

(57) ABSTRACT

The present subject matter comprises a simple, passive skylight dome with relatively tall partially vertical sides comprising partially transparent material which diffuses the transmitted light, and a mostly opaque sun shade near the top of the relatively tall partially vertical sides. The partially vertical sides are able to better intercept sunlight from low sun elevation angles than conventional horizontal skylights. The mostly opaque sun shade is able to block sunlight from high sun elevation angles to prevent such sunlight from entering the building below the dome. By enhancing the collection of low-sun-elevation-angle light, the subject matter improves the daylight performance of the skylight early and late in the day, and all day in the winter months. By reducing the collection of high-sun-elevation-angle light, the subject matter reduces the solar heat gain near solar noon in the summer months, thereby reducing air conditioning loads and related costs.

18 Claims, 5 Drawing Sheets

PASSIVE SKYLIGHT DOME CONFIGURED TO INCREASE LIGHT TO INCREASE COLLECTION AT LOW SUN ELEVATION ANGLES AND TO REDUCE LIGHT AT HIGH SUN ELEVATION ANGLES

RELATED APPLICATIONS

This application claims priority to and is a non-provisional of U.S. Provisional application No. 62/050,926, filed on 16 Sep. 2014 entitled "Passive Skylight Dome Configured to Increase Light Collection at Low Sun Elevation Angles and To Reduce Light at High Sun Elevation Angles", the entirety of which is incorporated herein by reference.

BACKGROUND

Conventional horizontal skylights suffer from poor sunlight collection when the sun is low in the sky, i.e., when the sun's elevation angle is small. This poor low-sun-elevation angle performance leads to poor lighting in the wintertime in most moderate latitudes, and to poor lighting early and late in the day in all locations. Previous attempts to solve this problem have sometimes used expensive tracking reflectors above the skylight penetration into the building, or sometimes used fixed reflectors or prismatic lenses above the skylight penetration with less than adequate performance.

Conventional horizontal skylights also suffer from excess sunlight collection when the sun is high in the sky, i.e., when the sun's elevation angle is large. This excess sunlight collection during summer months near solar noon increases solar heat gain with corresponding increases in air conditioning loads and costs. Previous attempts to solve this problem have sometimes used expensive blinds and baffles to block some of the excess sunlight collection with less than satisfactory performance, reliability, and cost.

The present subject matter uses a relatively tall diffusely transmitting dome to collect low sun elevation light, with an opaque shade near the top of the dome to block high sun elevation light, thereby solving both problems by both increasing inadequate sunlight collection during low sun elevation periods and also by decreasing excess sunlight collection during high sun elevation periods. The present subject matter solves both problems in a totally passive manner, requiring no moving parts and no seasonal change in configuration of the skylight. Therefore, the present subject matter represents a simple, reliable, cost-effective solution to two major problems for horizontal skylights.

This subject matter includes at least one skylight dome with relatively tall partially vertical sides comprising partially transparent material which diffuses the transmitted light, and at least one mostly opaque sun shade near the top of the relatively tall partially vertical sides. The partially vertical sides are able to better intercept sunlight from low sun elevation angles, in contrast to conventional horizontal skylights which are less well able to intercept such low-sun-elevation-angle light. The mostly opaque sun shade is able to block sunlight from high sun elevation angles to prevent such sunlight from entering the building below the dome. By enhancing the collection of low-sun-elevation-angle light, the subject matter improves the daylighting performance of the skylight early and late in the day year-around, and all day in the winter months of the year. By reducing the collection of high-sun-elevation-angle light, the subject matter reduces the solar heat gain near solar noon in the summer months, thereby reducing air conditioning loads and related costs for equipment and operating energy. The simple passive configuration of the subject matter, with no moving parts and no operational complexity, ensures high reliability and low maintenance.

These and many other advantages of the present subject matter will be readily apparent to one skilled in the art to which the invention pertains from a perusal of the claims, the appended drawings, and the following detailed description of preferred embodiments.

DETAILED DESCRIPTION

Figure 1A:
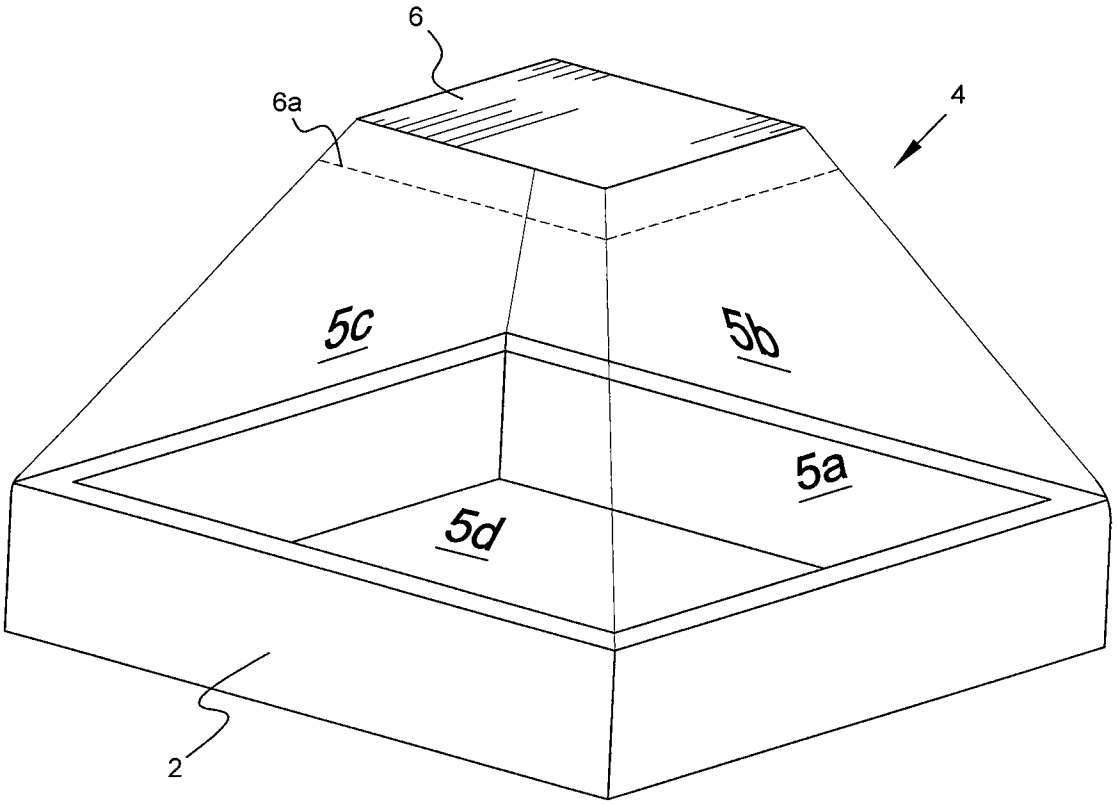
FIGS. 1*a* and 1*b* present a perspective view and top view respectively of one preferred embodiment of the new skylight subject matter, comprising a rectangular geometry for the dome and shade.

The present subject matter is best understood by referring to the four attached drawings, which show four preferred embodiments. Referring first to FIG. 1*a*, the new subject matter is an improved skylight dome, one preferred embodiment of which is shown. The present subject matter will normally comprise a transparent dome 4 which can be a variety of shapes, but is shown for example only as a rectangular pyramidal shape in FIG. 1*a*. The transparent dome 4 can be made from acrylic plastic or polycarbonate plastic or tempered glass. The transparent dome 4 can include surface features such as prisms and/or bulk additives such as white pigment to provide diffusion of the sunlight transmitted into the dome, thereby minimizing glare from direct solar rays. The transparent dome 4 comprises a geometry with partially vertical sides (panes 5*a*-5*d*) able to collect sunlight from low sun elevation angles near the horizon. A mostly opaque/reflective sun shade 6 is located near the top of the transparent dome 4 to block high-sun-elevation-angle light from entering the building below the dome. The sun shade 6 can have a reflective inner surface, either diffusely reflecting like white paint or specularly reflecting like aluminized film to enhance the delivery to the building below of diffuse light which enters the dome 4. The dome 4 with sun shade 6 of FIG. 1*a* is generally installed on a curb structure 2 which provides support and weatherproofing for the skylight.

For the preferred embodiment shown in FIG. 1*a*, the transparent dome 4 can be made from impact resistant acrylic plastic, to withstand hail and wind and sunlight exposure. The sun shade 6 can be made of the same material as the rest of the dome 4, but with a coating or film or sheet of mostly opaque material attached to the inner or outer surface of the shade 6 portion of the dome.

As would be apparent to one of ordinary skill in the art, the shape of the dome 4 and the sun shade 6 could comprise a variety of configurations while still providing the basic benefits of the present subject matter, with FIG. 1*a* showing just one preferred embodiment. FIG. 1*a* also shows the sun shade 6 may extend on to the partially vertical sides.

Figure 1B:
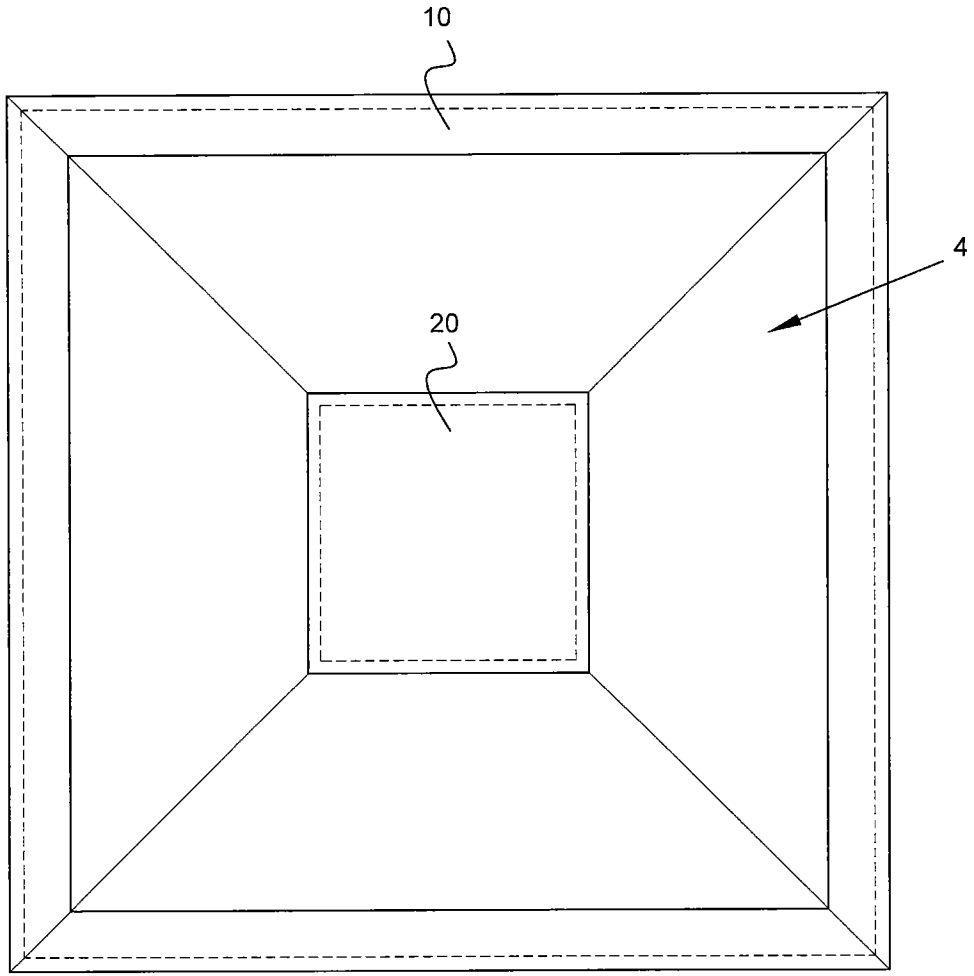

FIG. 1*b* is a top view of the embodiment of FIG. 1*a*. The area of the opening in the horizontal plane is generally represented as 10 and the area of the sun shade is generally represented as reference number 20.

Figure 2:
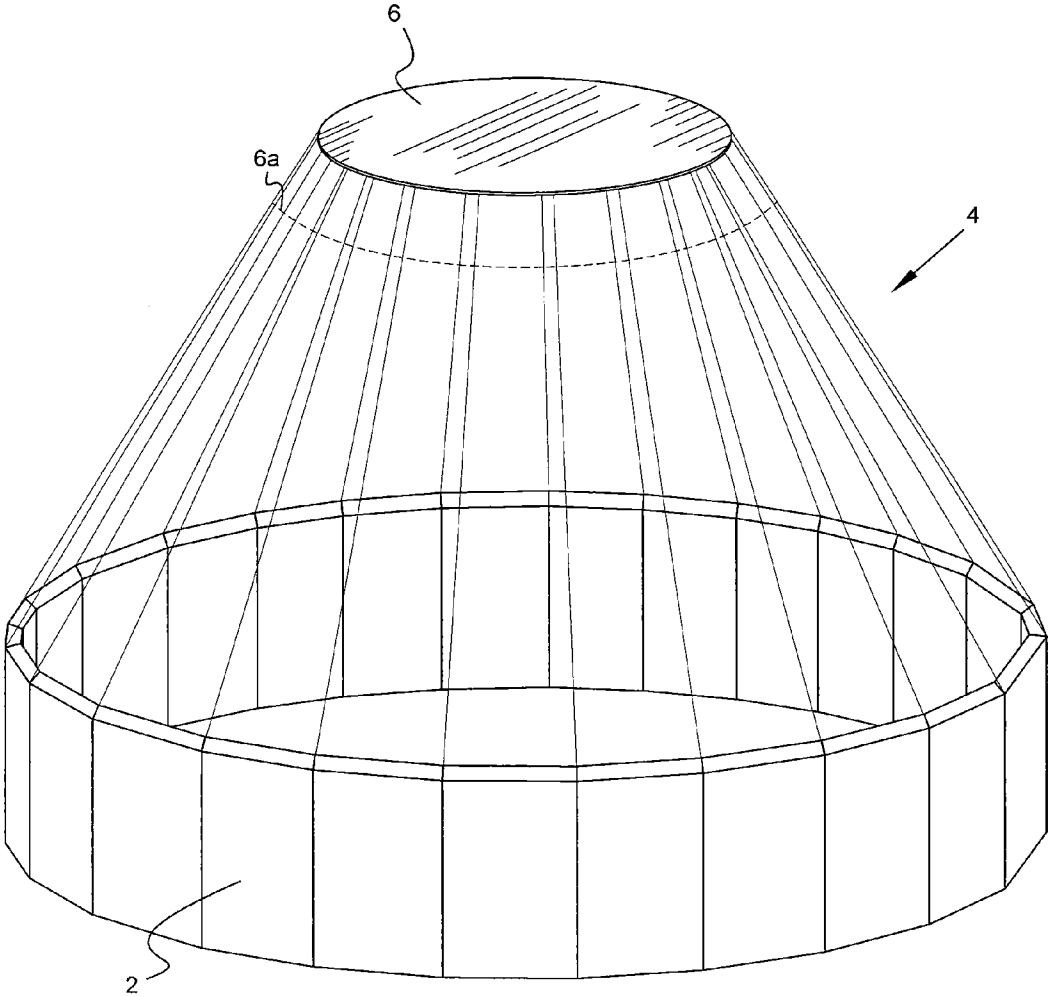
FIG. 2 presents a perspective view of a second preferred embodiment of the new skylight subject matter, comprising a circular geometry for the dome and shade.

Referring next to FIG. 2, a second preferred embodiment of the new subject matter is shown in a round geometry. The present subject matter will normally comprise a transparent dome 4 which can be a variety of shapes, but is shown for example only as a cylindrical cone shape in FIG. 2. The transparent dome 4 can be made from acrylic plastic or polycarbonate plastic or tempered glass. The transparent dome 4 can include surface features such a prisms and/or bulk additives such as white pigment to provide diffusion of the sunlight transmitted into the dome, thereby minimizing glare from direct solar rays. The transparent dome 4 comprises a geometry with partially vertical sides able to collect sunlight from low sun elevation angles near the horizon. A mostly opaque sun shade 6 is located near the top of the transparent dome 4 to block high-sun-elevation-angle light from entering the building below the dome. The circular sun shade 6 can have a reflective inner surface, either diffusely reflecting like white paint or specularly reflecting like aluminized film to enhance the delivery to the building below of diffuse light which enters the dome 4. The dome 4 with sun shade 6 of FIG. 2 is generally installed on a curb structure 2 which provides support and weatherproofing for the skylight.

For the second preferred embodiment shown in FIG. 2, the transparent dome 4 can be made from impact resistant acrylic plastic, to withstand hail and wind and sunlight exposure. The sun shade 6 can be made of the same material as the rest of the dome 4, but with a coating or film or sheet of mostly opaque material attached to the inner or outer surface of the shade 6 portion of the dome.

As would be apparent to one of ordinary skill in the art, the shape of the dome 4 and the sun shade 6 could comprise a variety of configurations while still providing the basic benefits of the present subject matter, with FIG. 2 showing just one preferred embodiment.

Figure 3:
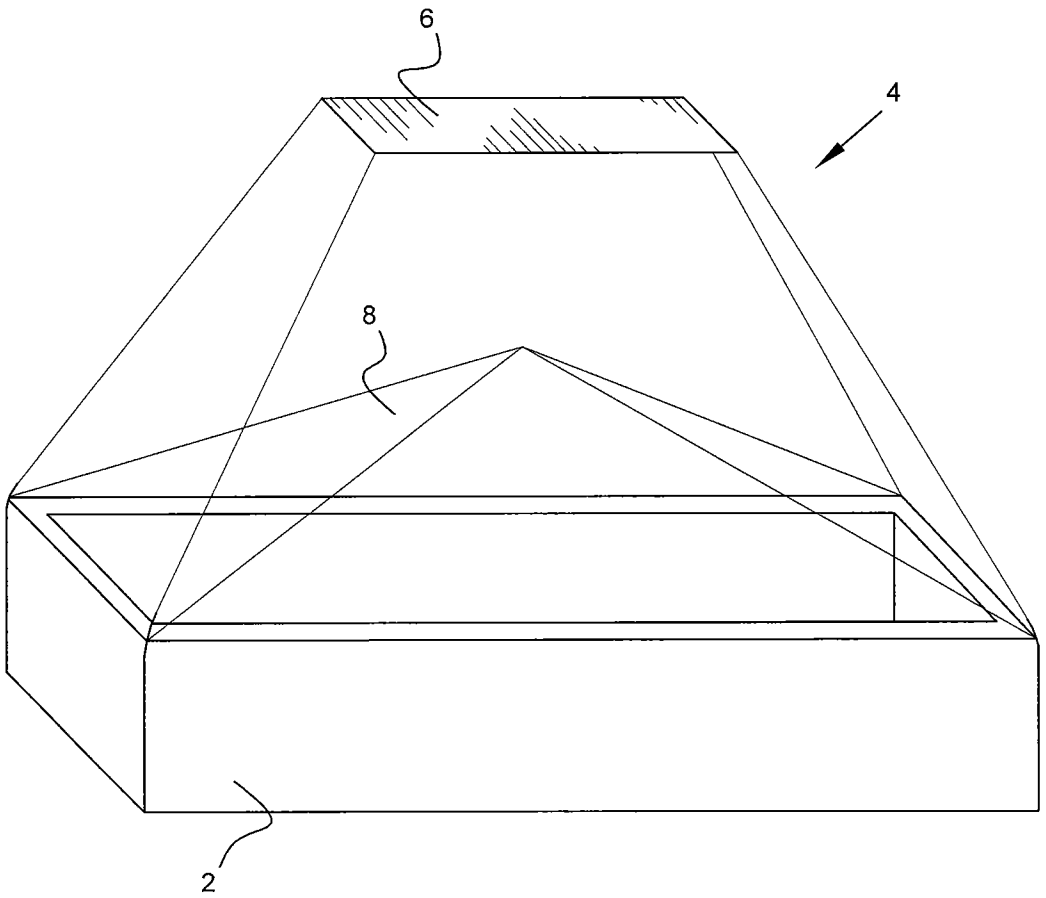
FIG. 3 presents a perspective view of a third preferred embodiment of the new skylight subject matter, comprising a rectangular geometry for the dome and shade, with a second interior dome for the better thermal performance.

Referring next to FIG. 3, a third preferred embodiment of the new subject matter is shown in a rectangular geometry. The present subject matter will normally comprise a transparent dome 4 which can be a variety of shapes, but is shown for example only a rectangular pyramidal shape in FIG. 3. The transparent dome 4 can be made from acrylic plastic or polycarbonate plastic or tempered glass. The transparent dome 4 can include surface features such a prisms and/or bulk additives such a white pigment to provide diffusion of the sunlight transmitted into the dome, thereby minimizing glare from direct solar rays. The transparent dome 4 comprises a geometry with partially vertical sides to collect sunlight from low sun elevation angels near the horizon. A mostly opaque sun shade 6 is located near the top of the transparent dome 4 to block high-sun-elevation-angle light from entering the building below the dome. The rectangular sun shade 6 can have a reflective inner surface, either diffusely reflecting like white paint or specularly reflecting like aluminized film, to enhance the delivery to the building below of diffuse light which enters the dome 4. The dome 4 with sun shade 6 of FIG. 3 is generally installed on a curb structure 2 which provides support and weatherproofing for the skylight.

For the third preferred embodiment shown in FIG. 3, the transparent dome 4 can be made from impact resistant acrylic plastic, to withstand hail and wind and sunlight exposure. The sun shade 6 can be made of the same material as the rest of the dome 4, but with a coating or film or sheet of mostly opaque material attached to the inner or outer surface of the shade 6 portion of the dome.

The primary difference between the third embodiment shown in FIG. 3 compared to the first embodiment shown in FIG. 1*a* is the addition of a second dome 8 to the skylight configuration. This secondary dome 8 can be placed beneath the dome 4 to reduce the heat loss from the building in the winter months, and to reduce the heat gain into the building in the summer months. This secondary dome 8 can be clear or diffuse in terms of transmitting sunlight. The secondary dome 8 may be made of the same material or may be of another material since it does not need to be protected from the environment.

As would be apparent to one of ordinary skill in the art, the shape of the dome 4, the second dome 8, and the sun shade 6 could comprise a variety of configurations while still providing the basic benefits of the present subject matter, with FIG. 3 showing just one preferred embodiment.

Figure 4:
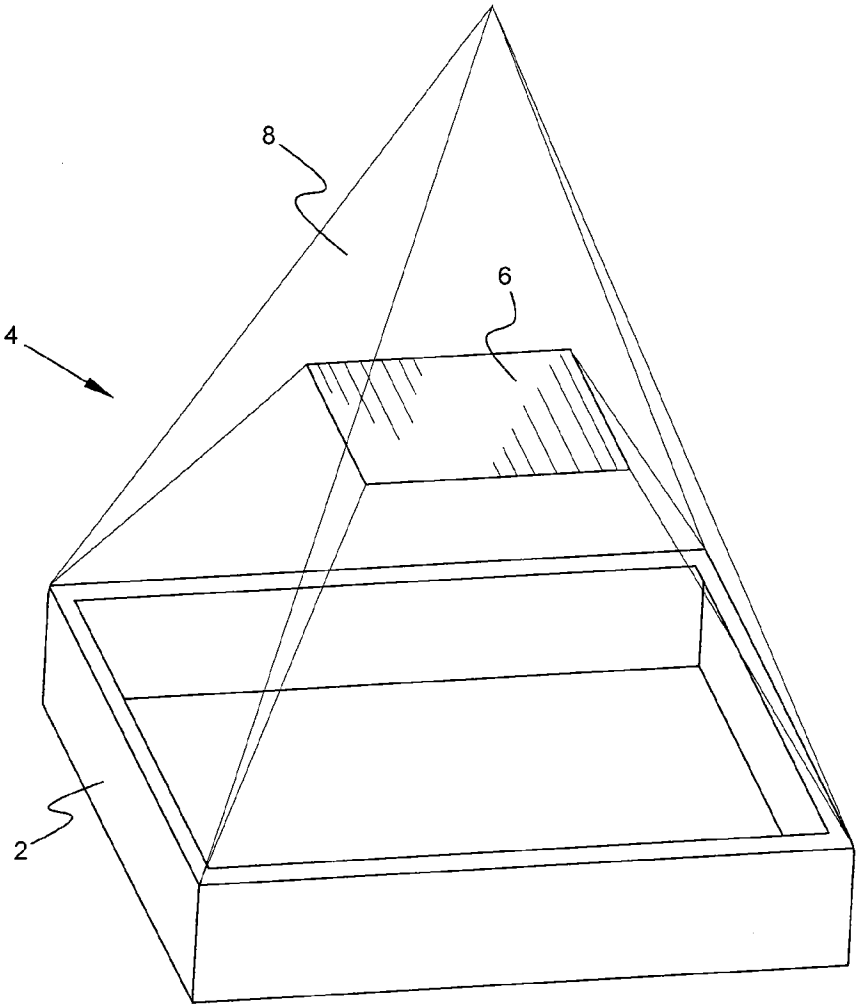
FIG. 4 presents a perspective view of a third preferred embodiment of the new skylight subject matter, comprising a rectangular geometry for the dome and shade, with a second exterior dome for better thermal performance.

Referring next to FIG. 4, a fourth preferred embodiment of the new subject matter is shown in a rectangular geometry. The present subject matter will normally comprise a transparent dome 4 which can be a variety of shapes, but is shown for example only as a rectangular pyramidal shape in FIG. 4. The transparent dome 4 can be made from acrylic plastic or polycarbonate plastic or tempered glass. The transparent dome 4 can include surface features such as prisms and/or bulk additives such as white pigment to provide diffusion of the sunlight transmitted into the dome, thereby minimizing glare from direct solar rays. The transparent dome 4 comprises a geometry with partially vertical sides able to collect sunlight from low sun elevation angels near the horizon. A mostly opaque sun shade 6 is located near the top of the transparent dome 4 to block high-sun-elevation-angle light from entering the building below the dome. The rectangular sun shade 6 can have a reflective, either diffusely reflecting like white paint or specularly reflecting like aluminized film, inner surface to enhance the delivery to the building below of diffuse light which enters the dome 4. The dome 4 with sun shade 6 of FIG. 4 is generally installed on a curb structure 2 which provides support and weatherproofing for the skylight.

For the fourth preferred embodiment shown in FIG. 4, the transparent dome 4 can be made from impact resistant acrylic plastic, to withstand hail and wind and sunlight exposure. The sun shade 6 can be made of the same material as the rest of the dome 4, but with a coating or film or sheet of mostly opaque material attached to the inner or outer surface of the shade 6 portion of the dome.

The primary difference between the fourth embodiment shown in FIG. 4 compared to the first embodiment shown in FIG. 1*a* is the addition of a second dome 8 to the skylight configuration. This secondary dome 8 can be placed above the dome 4 to reduce the heat loss from the building in the winter months, and to reduce the heat gain into the building in summer months. This outer second dome 8 can be clear or diffuse in terms of transmitting sunlight. Additionally, the volume between the first and second dome may be filled will a gas such as air, or may be filled with an insulating gas, such as argon, carbon dioxide, $CF_4$, or $SF_6$ to further improve the insulating properties of the skylight. This same introduction of insulating gas is also envisioned as being beneficial to the embodiment of FIG. 3.

As would be apparent to one of ordinary skill in the art, the shape of the dome 4, the second dome 8 and the sun shade 6 could comprise a variety of configurations while still providing the basic benefits of the present subject matter, with FIG. 4 showing just one preferred embodiment.

The new skylight subject matter, of the four embodiments shown in FIGS. 1*a* through 4, and many other embodiments which can be conceived by those of ordinary skill in the art, offers many advantages over conventional skylights of the current state of the art. Unlike far more expensive skylight units which use motors and mechanisms to orient mirrors under the dome to help collect low sun elevation angle light, the new subject matter uses simpler, cheaper, passive means to accomplish the same objective. Unlike other less effective skylight units which use curved mirrors or prismatic lenses, the new subject matter uses simple, partially vertical, light-transmitting and light-diffusing surfaces to accomplish the same objective. Unlike conventional horizontal skylights, the new subject matter is able to collect far more low-sun-elevation-angle sunlight, providing much higher illumination early and late in the day, and in the wintertime when the sun is low in the sky all day for non-tropical latitudes. The new skylight subject matter thereby saves more energy for conventional electrical lighting, and therefore provides better economics, i.e., better return on investment and faster payback time.

An aspect of the current subject matter as discussed above is the relationship of area of the shaded portion to that of the unshaded portion. The subject matter seeks to maximize the collection of low sun elevation light and minimize the entry of high sun elevation light. The area of the sun shade 20 is less than the area of the opening 20 and preferably greater or equal to the non-shaded area as measured from a projection on a horizontal plane, (greater or equal to half the area of the opening 10). Likewise, in maximizing the low sun elevation light, it is preferable that the height of the transparent dome is equal or greater than one of the width or length of the base, or both. These parameters have a direct effect of minimizing unwanted light and maximizing desired light.

Another aspect of the current subject matter is the use of a one way reflective material on the inter portion of the transparent dome. The reflective inner coating allows light to pass from the outside into the transparent dome, but reflects at least some of the light incident upon it from the interior side. For example with respect to FIG. 1*a*, a portion of the light passing through pane 5*a* from the low sun is reflected downward off the reflective interior surface of pane 5*c*, similarly light passing through pane 5*c*, is reflected downward off the interior surface of pane 5*a*. This one way reflection may be accomplished with thin film filters, coating or polarization. In addition, the sun shade 6 may also have one way reflective material but in the opposite manner than described above, such that light from the high sun elevation is reflected back, but light accident from the interior of the transparent dome is allow to pass. The important aspect of the sun shade is that it reflects/blocks high sun elevation light with the reflection characteristics of interior incident light being secondary to that primary function. With respect to the reflective properties of the transparent dome described above, the reflective material may be incorporated within, on the outside or inside of the panes of the dome. The above reflective properties may be incorporated not only on the dome 4, but also in the secondary dome 8.

The new skylight subject matter of all the embodiments shown in FIGS. 1*a* through 4, and of many other embodiments which will be generated by those skilled in the art of skylights based upon this subject matter, also blocks excessive sunlight when the sun is nearly overhead in the summer months. Blocking this excessive light and heat from entering the building will reduce air conditioning loads in the summer, thereby reducing the costs for cooling equipment and the energy to run such equipment. A more comfortable level of illumination will result from this shading of high-sun-elevation-angle light. The building occupants will be more comfortable from the reduced heat and light provided by this simple shade during the hours around solar noon in the hot summer months.

The opening or curb is envisioned as being of several shapes, such as rectangular, square, or polygonal as shown in the Figs. The shape may also be from a cross section of a rotated solid, such as circular or elliptical. In addition, while as shown in the Figs as being a flat separate surface from the wall, the sun shade may also extend onto the walls as shown with reference to 6*a* and its projection onto the horizontal plane may be of any practical geometric shape to include rectangular, circular, elliptical, star, cross etc.

While preferred embodiments of the present invention have been described, it is to be understood that the embodiments described are illustrative only and that the scope of the invention is to be defined solely by the appended claims when accorded a full range of equivalence. Many variations and modifications naturally occurring to those of skill in the art from a perusal hereof are likewise encompassed.

What I claim is:

1. A skylight dome for reducing the amount of high sun elevation light passing into an opening of a building and maximizing the admittance of low sun elevation light into the opening, comprising:

at least one partially vertical wall extending from the opening to a top portion of the dome, said partially vertical wall comprised of at least a partially light-transmitting material and defining of the opening;

a partially opaque sun shade on the top portion of the dome; wherein a projection of the sun shade upon the opening defines a first area greater than zero and less than a second area defined by the opening in the horizontal plane, wherein the opaque sun shade comprises white paint or specularly reflecting aluminized film on the top portion of the dome.

2. The skylight dome of claim 1, wherein the first area is greater or equal to half of the second area.

3. The skylight dome of claim 1, wherein a height of the at least one partially vertical wall is greater than one of a width or length of the opening.

4. The skylight dome of claim 1, wherein the opening comprises a polygon in the horizontal plane.

5. The skylight dome of claim 1, wherein the top portion of the dome comprises an extension of the at least one partially vertical wall.

6. The skylight dome of claim 1, wherein the opening comprises a cross section of a rotatable solid in the horizontal plane.

7. The skylight dome of claim 1, further comprising a second transparent dome having at least one wall extending from the opening and above the top portion of the dome, said at least one wall comprised of at least a partially light-transmitting material and enveloping the at least one partially vertical wall.

8. The skylight dome of claim 1, further comprising a second transparent dome having at least one wall extending from the opening to below the top portion of the dome, said at least one wall comprised of at least a partially light-transmitting material and the at least one partially vertical wall enveloping the second transparent dome.

9. The skylight dome of claim 1, wherein the at least one partially vertical wall comprises a filter for selectively passing light into the dome.

10. A skylight dome for reducing the amount of high sun elevation light passing into an opening of a building and maximizing the admittance of low sun elevation light into the opening, comprising:

at least one partially vertical wall extending from the opening to a top portion of the dome, said partially vertical wall comprised of at least a partially light-transmitting material and defining a boundary of the opening;

a partially opaque sun shade on the top portion of the dome; wherein a projection of the sun shade upon the opening defines a first area greater than zero and less than a second area defined by the opening in the horizontal plane further comprising the at least one partially than zero and less than a second area defined by the opening in the horizontal plane further comprising the at least one partially vertical wall comprising a partially light-diffusing material.

11. A skylight dome for reducing the amount of high sun elevation light passing into an opening of a building and maximizing the admittance of low sun elevation light into the opening, comprising:

at least one partially vertical wall extending from the opening to a top portion of the dome, said partially vertical wall comprised of at least a partially light-transmitting material and defining a boundary of the opening;

a partially opaque sun shade on the top portion of the dome; wherein a projection of the sun shade upon the opening defines a first area greater than zero and less than a second area defined by the opening in the horizontal plane wherein the at least one partially vertical wall has a first side exposed to the exterior of the dome and a second side exposed to the interior of the dome, wherein the first and second sides are substantially parallel.

12. A skylight dome for reducing the amount of high sun elevation light passing into an opening of a building and maximizing the admittance of low sun elevation light into the opening, comprising:

at least one partially vertical wall extending from the opening to a top portion of the dome, said partially vertical wall comprised of at least a partially light-transmitting material and defining a boundary of the opening;

a partially opaque sun shade on the top portion of the dome; wherein a projection of the sun shade upon the opening defines a first area greater than zero and less than a second area defined by the opening in the horizontal plane wherein the at least one partially vertical wall comprises a filter for selectively passing light into the dome and a second filter for selectively reflecting light into the opening.

13. A skylight dome for reducing the amount of high sun elevation light passing into an opening of a building and maximizing the admittance of low sun elevation light into the opening, comprising:

at least one partially vertical wall extending from the opening to a top portion of the dome, said partially vertical wall comprised of at least a partially light-transmitting material and defining a boundary of the opening;

a partially opaque sun shade on the top portion of the dome;

wherein a projection of the sun shade upon the opening defines a first area greater than zero and less than a second area defined by the opening in the horizontal plane, wherein the material comprises impact resistant acrylic plastic, polycarbonate plastic or tempered glass.

14. A skylight dome for reducing the amount of high sun elevation light passing into an opening of a building and maximizing the admittance of low sun elevation light into the opening, comprising:

at least one partially vertical wall extending from the opening to a top portion of the dome, said partially vertical wall comprised of at least a partially light-transmitting material and defining a boundary of the opening;

a partially opaque sun shade on the top portion of the dome; wherein a projection of the sun shade upon the opening defines a first area greater than zero and less than a second area defined by the opening in the horizontal plane, wherein the at least one partially vertical wall comprises surface features selected from the group consisting of prisms and bulk additives to provide diffusion of the sunlight transmitted into the dome.

15. A method for reducing the amount of high sun elevation light passing into an opening of a building and maximizing the admittance of low sun elevation light into the opening comprising:

positioning a transparent dome over the opening of a building, wherein the transparent dome comprises at least one partially vertical wall extending from the opening to a top portion of the dome, said partially vertical wall comprised of at least a partially light-transmitting material and defining a boundary of the opening;

depositing white paint or specularly reflecting aluminized film on the top portion of the dome to form a partially opaque sun shade on the top portion of the dome; wherein a projection of the sun shade upon the opening defines a first area greater than zero and less than a second area defined by the opening in the horizontal plane;

blocking high sun elevation light incident on the transparent dome from passing into the opening with the partially opaque sun shade on the top portion of the dome; and, passing low sun elevation light through the at least one partially vertical wall into the transparent dome and into the opening.

16. The method of claim 15, wherein the step of passing low sun elevation light through the at least one partially vertical wall into the transparent dome and into the opening further comprises, reflecting the low sun elevation light passed through the at least one partially vertical wall off another of the at least one partially vertical wall into the passage.

17. The method of claim 15 further comprising the step of positioning a second transparent dome over the opening, wherein the second transparent dome is within the transparent dome.

18. The method of claim 15 further comprising the step of positioning a second transparent dome over the opening, wherein the transparent dome is within the second transparent dome.

* * * * *